US006145262A

United States Patent [19]

Schrader et al.

[11] Patent Number: 6,145,262

[45] Date of Patent: Nov. 14, 2000

[54] DOWEL BAR SLEEVE SYSTEM AND METHOD

[75] Inventors: Ernest K. Schrader, Walla Walla, Wash.; Russell Boxall, Matthews, N.C.; Nigel K. Parkes, Tucker, Ga.

[73] Assignee: Expando-Lok, Inc., Walla Walla, Wash.

[21] Appl. No.: 09/190,322

[22] Filed: Nov. 12, 1998

[51] Int. Cl.[7] ..... E04B 1/48; E01C 11/02

[52] U.S. Cl. ..... 52/396.02; 52/699; 52/700; 52/701; 52/318; 404/52; 404/59; 404/62

[58] Field of Search ..... 52/396.02, 318, 52/396.05, 704, 677, 699, 700, 701; 404/52, 59, 62, 74, 63

[56] References Cited

U.S. PATENT DOCUMENTS

| | | | |
|---|---|---|---|
| 2,163,397 | 6/1939 | Friberg | 404/63 |
| 2,186,104 | 1/1940 | Geyer et al. | 404/60 |
| 4,733,513 | 3/1988 | Schrader et al. . | |
| 5,005,331 | 4/1991 | Shaw et al. | 52/396.02 |
| 5,216,862 | 6/1993 | Shaw et al. | 52/396.02 |
| 5,366,319 | 11/1994 | Hu et al. | 404/52 |
| 5,470,174 | 11/1995 | Hu et al. | 404/52 |
| 5,487,249 | 1/1996 | Shaw et al. . | |
| 5,713,174 | 2/1998 | Kramer | 52/396.02 |
| 5,797,231 | 8/1998 | Kramer . | |

FOREIGN PATENT DOCUMENTS 59-171 2/1983 European Pat. Off. .

*Primary Examiner*—Christopher T. Kent
*Assistant Examiner*—Jennifer I. Thissell
*Attorney, Agent, or Firm*—Christensen O'Connor Johnson Kindness PLLC

[57] ABSTRACT

A rectangular dowel bar sleeve is disclosed for receiving dowel bars and tie-bars that allows opening and closing of joints between adjacent cast-in-place slabs and pavements while allowing differential lateral movement of adjacent cast-in-place slabs in either direction parallel to the longitudinal axis of the joint and while preventing differential vertical movement of the slabs on either side of the joint. A form panel having an alignment ridge and spaced apart holes for attaching blockout bars to the form panel is disclosed. The blockout bars can be used to accurately create voids extending perpendicularly from the form panel and having upper and lower surfaces that are parallel to the intended upper surface of the cast-in-place slab. A dowel bar sleeve positioner is disclosed having a flange portion for mounting the positioner to a form panel or facing and having a stub portion projecting perpendicularly from the form for accurately positioning within a cast-in-place slab a dowel bar sleeve so that the top and bottom surfaces of the dowel bar sleeve are parallel to the intended upper surface of the slab.

17 Claims, 6 Drawing Sheets

DOWEL BAR SLEEVE SYSTEM AND METHOD

BACKGROUND OF THE INVENTION

1. Field of the Invention

This invention relates generally to dowel bars used for restricting relative vertical movement between adjacent cast-in-place slabs and more particularly to a dowel bar sleeve system and method adapted to allow relative lateral movement of the slabs along the longitudinal axis of the joint between the slabs and adapted to allow the joint to open and close.

2. Related Art

FIG. 1 is a plan view of adjacent cast-in-place slabs 100-1, 100-2, 100-3, and 100-4 (collectively 100). As is well known in the art, joints 102-1, 102-2, 102-3, and 102-4 (collectively 102) separate slabs 100. Joints 102 are useful for, among other things, reducing failure of slabs 100 in the form of cracking due to expansion and/or contraction of adjacent slabs 100. As is also well known in the art, dowel bars 104-1, 104-2, 104-3, 104-4, 104-5, 104-6, 104-7, and 104-8 (collectively 104) spanning a joint 102 allow the adjacent cast in place slabs to move apart from each other parallel to the dowel bars 104 spanning the joint 102 between the slabs 100. Dowels 104 could have a circular or rectangular cross-section. Dowels 104 are typically used to prevent relative vertical movement between adjacent slabs, which can be visualized as "into or out from the paper" in FIG. 1.

Movement of slabs 100 away from each other along a dowel 102 is commonly referred to as the joint "opening". Similarly, movement of slabs 100 toward each other can be referred to as the joint "closing". For instance, joint 102-1 would open as slab 100-1 moves in the direction indicated by arrow 106 and/or as slab 100-2 moves in the direction indicated by arrow 108. Arrows 106 and 108 point perpendicular to the longitudinal axis of joint 102-1, while arrows 110 and 112 point parallel to the longitudinal axis of joint 102-1.

A significant shortcoming of prior art dowel bars is that they tend to restrict relative lateral movement between adjacent cast-in-place slabs. For instance, dowel bars 104-1 and 104-2 would undesirably restrict slabs 100-1 and 100-2 from moving relative to each other along the longitudinal axis of joint 102-1, which is parallel to arrows 110 and 112. For instance, U.S. Pat. Nos. 5,005,331, 5,216,862, and 5,487,249 issued to Shaw et al., which are incorporated herein by reference, disclose tubular dowel receiving sheaths for use with dowel bars having a circular cross-section. Such dowel bars and receiving sheaths typically do not allow relative lateral movement of adjacent cast-in-place slabs along the longitudinal axis of the joint between the slabs.

This shortcoming has been addressed by U.S. Pat. No. 4,733,513 ('513 patent) issued to Schrader et al., which is incorporated herein by reference. The '513 patent discloses a dowel bar having a rectangular cross-section and resilient facings attached to the sides of the bar. The resilient facings allow for relative lateral movement of adjacent cast-in-place slabs. The '513 patent, however, undesirably requires the resilient facing to be attached to the rectangular dowel bar, which can be costly.

Accordingly, there is a need in the prior art for a less expensive apparatus that prevents relative vertical movement between adjacent cast-in-place slabs, while allowing the joint between the slabs to open and allowing relative lateral movement between the slabs.

SUMMARY OF THE INVENTION

The present invention includes a dowel bar sleeve for receiving a dowel bar that has substantially planar, substantially parallel upper and lower surfaces. The dowel bar sleeve has a substantially planar top, first and second side faces, and a substantially planar bottom. The top and bottom of the dowel bar sleeve are spaced apart such that, upon being inserted into the dowel bar sleeve, the dowel bar is substantially prevented from moving in a direction perpendicular to the top and bottom of the dowel bar sleeve. The top and bottom of the dowel bar sleeve are preferably made of a substantially incompressible substantially non-malleable material. The top and bottom of the dowel bar sleeve are preferably substantially wider than the upper and lower surfaces of the dowel bar so that, upon being inserted into the dowel bar sleeve, the dowel bar can move in a direction perpendicular to the first and second side faces of the dowel bar sleeve. The dowel bar sleeve also preferably includes easily collapsible material inside the dowel bar sleeve or other means for initially centering a dowel bar between the first and second side faces of the dowel bar sleeve. In an alternate configuration, the bottom of the dowel bar sleeve could include first and second substantially planar bottom surfaces spaced apart from each other.

The present invention includes a form panel or facing having an alignment ridge and spaced apart holes for attaching blockout bars to the form panel. The blockout bars can be used to accurately create voids extending perpendicularly from the form panel or facing and having upper and lower surfaces that are parallel to the intended upper surface of a cast-in-place slab. The blockout bar could be wider than the dowel bar so that a dowel bar inserted into the void could move laterally within the void. Alternatively, voids for allowing lateral movement of a dowel bar within the cast-in-place slab could be provided by a dowel bar sleeve, which could be placed onto a blockout bar before pouring the cast-in-place slab. The form panel, or facing, and the blockout bars hold the dowel bar sleeves in proper alignment, namely, parallel to the intended upper surface of the slab, while the slab is poured and hardens.

The present invention further includes a system and method for temporarily attaching square and rectangular dowel bar sleeves onto construction forms against which concrete is placed during creation of a joint between adjacent cast-in-place slabs. The system includes a dowel bar sleeve positioner having a flange for mounting the positioner to a form panel or facing and having a stub projecting perpendicularly from the flange for accurately positioning a dowel bar sleeve within a cast-in-place slab so that the top and bottom surfaces of the dowel bar sleeve are parallel to the intended upper surface of the slab. The method includes the steps of: attaching a dowel bar sleeve positioner to a form panel, temporarily attaching the dowel bar sleeve to the dowel bar sleeve positioner so that the top of the sleeve is substantially parallel to the intended upper surface of the slab, pouring the cast-in-place slab, and removing the panel and the dowel bar sleeve holder after the cast-in-place material has hardened. In addition, a pin could be inserted through holes in the dowel bar sleeve and in the positioner.

DETAILED DESCRIPTION OF THE PREFERRED EMBODIMENTS

Figure 2:
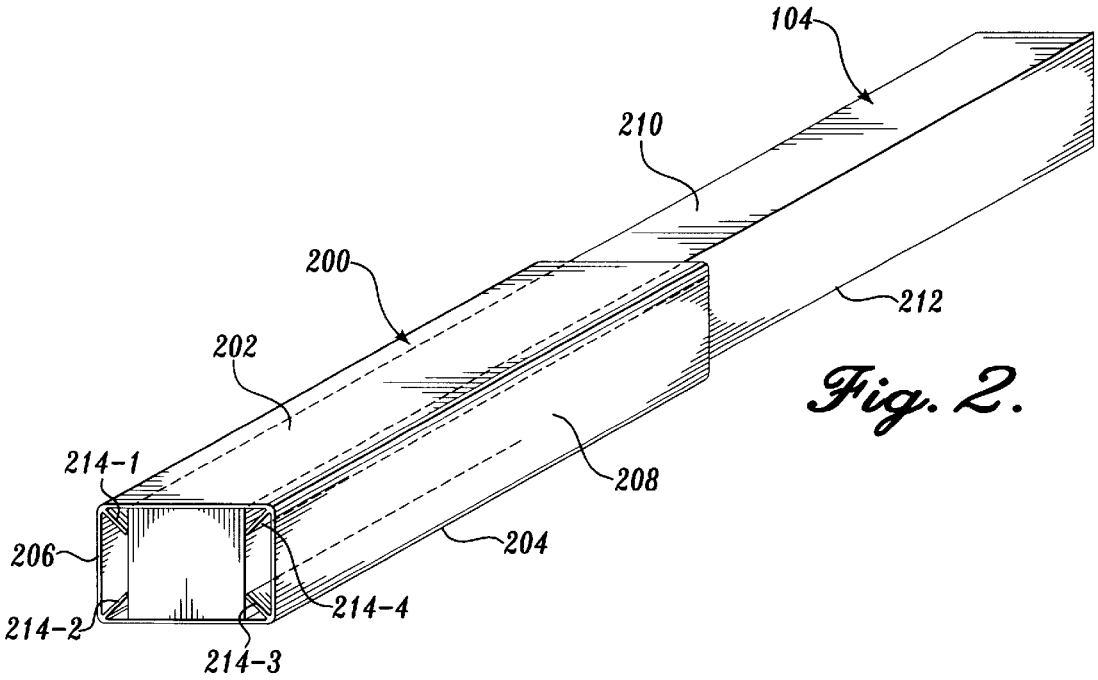
FIG. 2 depicts a dowel bar with a square cross-sectional area inserted into a dowel bar sleeve in accordance with the principles of this invention.

Referring to FIG. 2, a dowel bar sleeve 200 according to the principles of this invention is depicted, with a dowel bar 104 having a square cross-sectional area inserted into dowel bar sleeve 200. Dowel bar sleeve 200 includes a top 202, a bottom 204, and two sides 206 and 208, which are all preferably substantially planar. Top 202 and bottom 204 are preferably substantially parallel to each other, and sides 206 and 208 are preferably substantially perpendicular to top 202 and bottom 204.

The upper surface 210 and lower surface 212 of dowel bar 104 are preferably substantially planar and preferably substantially parallel to each other. Top 202 and bottom 204 are preferably spaced apart such that upper surface 210 and lower surface 212 of dowel bar 104 engage the top 202 and bottom 204 of the dowel bar sleeve, respectively, thereby preventing movement of dowel bar 104 in a direction perpendicular to the top 202 and the bottom 204 of the dowel bar sleeve 200.

In addition, top 202 and bottom 204 of dowel bar sleeve 200 are preferably wider than the upper surface 210 and lower surface 212, respectively, of dowel bar 104, thereby permitting dowel bar 104 to move in either direction perpendicular to side faces 206 and 208 of dowel bar sleeve 200. Dowel bar 104 can also move within dowel bar sleeve 200 in either direction along the longitudinal axis of dowel bar 104.

FIG. 2 shows easily collapsible fins 214-1, 214-2, 214-3, and 214-4 (collectively 214) inside dowel bar sleeve 200. Fins 214 could extend the entire length of dowel bar sleeve 200, or, as will be apparent those skilled in the art and others, fins 214 could be present intermittently along the length of dowel bar sleeve 200. Fins 214 preferably centrally locate dowel bar 104 between sides 206 and 208 of dowel bar sleeve 200 and provide minimal resistance to movement of dowel bar 104 toward sides 206 or 208. For example, resistance on the order of about 10 pounds per inch of dowel bar length causing movement of 0.050 inches, and 70 pounds per inch of dowel bar length causing movement of 0.100 inches for a ¾ inch square dowel bar. As will be apparent to those skilled in the art and others, easily collapsible material in other forms, such as fingers, could also be used without departing from the scope of this invention.

Figure 1:
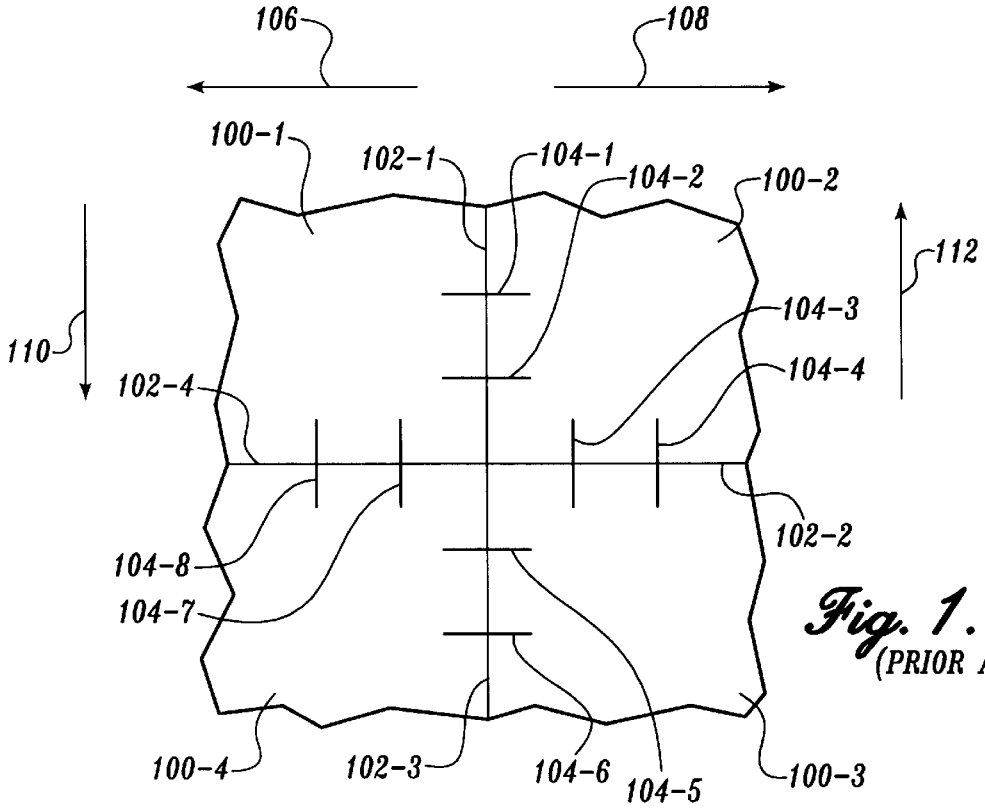
Fig. 1. (PRIOR ART)
FIG. 1 is a plan view showing prior art dowel bars spanning joints between cast-in-place slabs.
Figure 3:
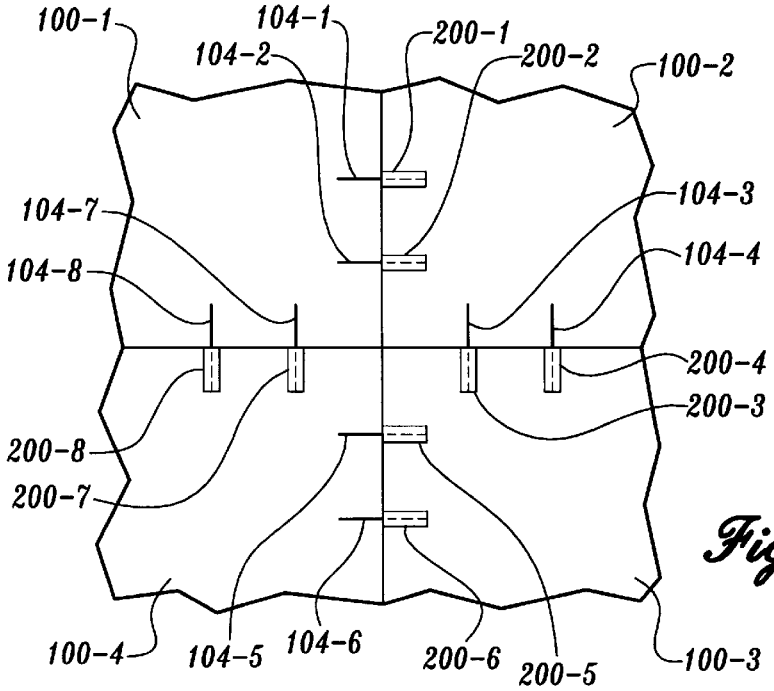
FIG. 3 is a plan view similar to FIG. 1 depicting dowel bars inserted into dowel bar sleeves.

FIG. 3 is a plan view similar to FIG. 1 showing dowel bars 104 spanning joints 102 and having been inserted into dowel bar sleeves 200-1, 200-2, 200-3, 200-4, 200-5, 200-6, 200-7, and 200-8 (collectively 200). By restricting movement of dowels 104 in either direction perpendicular to the tops 200 and bottoms 204 of the dowel bar sleeves 200 into which the dowel bars 104 have been inserted, relative vertical movement of adjacent slabs 100 is restricted. By allowing dowels 104 to move in either direction perpendicular to sides 206 and 208 of dowel bar sleeves 200 into which dowel bars 104 have been inserted, relative lateral movement of adjacent slabs 100 is allowed. Similarly, by allowing dowel bars 104 to move in either direction along the longitudinal axis of dowel bars 104 within the dowel bar sleeves into which the dowel bars 104 have been inserted, opening and closing of joints between slabs 100 is allowed.

FIG. 3 shows one-half of each dowel bar 104 inserted into a dowel bar sleeve 200. As will be apparent to those having skill in the art and others, the second half of each dowel bar 104 could also be inserted into a separate dowel bar sleeve without departing from the scope of this invention. Use of a second dowel bar sleeve 200 would allow for additional lateral movement of adjacent slabs in either direction parallel to the longitudinal axis of the joint between the slabs.

Figure 4:
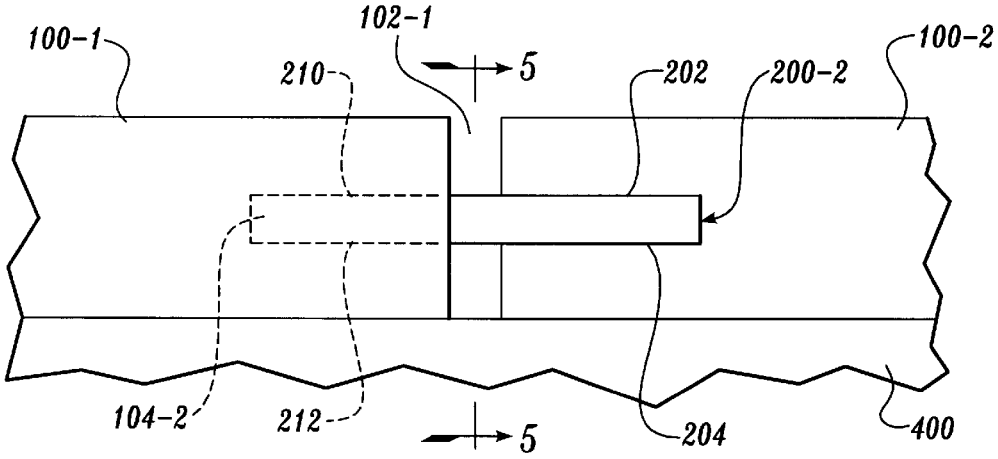
FIG. 4 is a section view of a dowel bar spanning a joint and showing one end of the dowel bar inserted into a dowel bar sleeve.

FIG. 4 is a section view of dowel bar 104-2 spanning joint 102-1. FIG. 4 shows slabs 100-1 and 100-2 in contact with base 400, which is typically the ground. FIG. 4 shows one end of dowel bar 104-2 inserted into dowel bar sleeve 200-2. As illustrated in FIG. 4, the outer surfaces of top 202 and bottom 204 of dowel bar sleeve 200 preferably directly and solidly contact faces of contact slab 100-2, and the inner surfaces of top 202 and bottom 204 of dowel bar sleeve 200 preferably directly and solidly contact upper surface 210 and lower surface 212, respectively, of dowel bar 104-2, which restricts relative vertical movement between slabs 100-1 and 100-2.

Top 202 and bottom 204 of dowel bar sleeve 200 are preferably manufactured smooth and precisely flat. Preferably, there will be no air space or gap between upper surface 210 and lower surface 212 of dowel bar 104 and the top 202 and bottom 204 of dowel bar sleeve 200. In order to assure that dowel bar sleeve 200 does not allow differential vertical movement a joint, such as joint 102-1, dowel bar sleeve 200 is preferably composed of a very incompressible and non-malleable material. For instance, a special formulation ABS with deformation of about 0.001 inch or less at a load of about 2,000 pounds per inch of dowel length for a ¾ inch square dowel bar could be used. In order to further assure control of vertical compression of dowel bar sleeve 200 and control of vertical differential movement on each side of a joint 102, top 202 and bottom 204 of dowel bar sleeve 200 are manufactured to a minimum thickness, such as, for example, on the order of about 0.050 inch or less.

Figure 5:
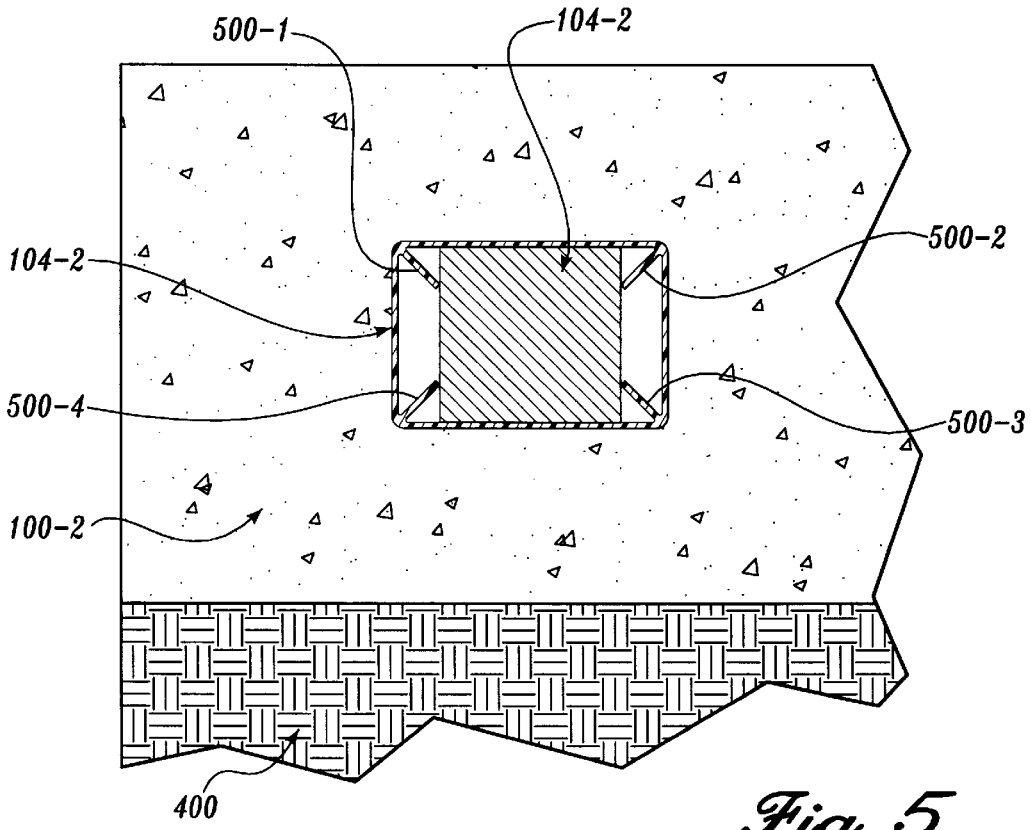
FIG. 5 is a partial cross-sectional view along sectional view line 5—5 in FIG. 4.
Figure 6:
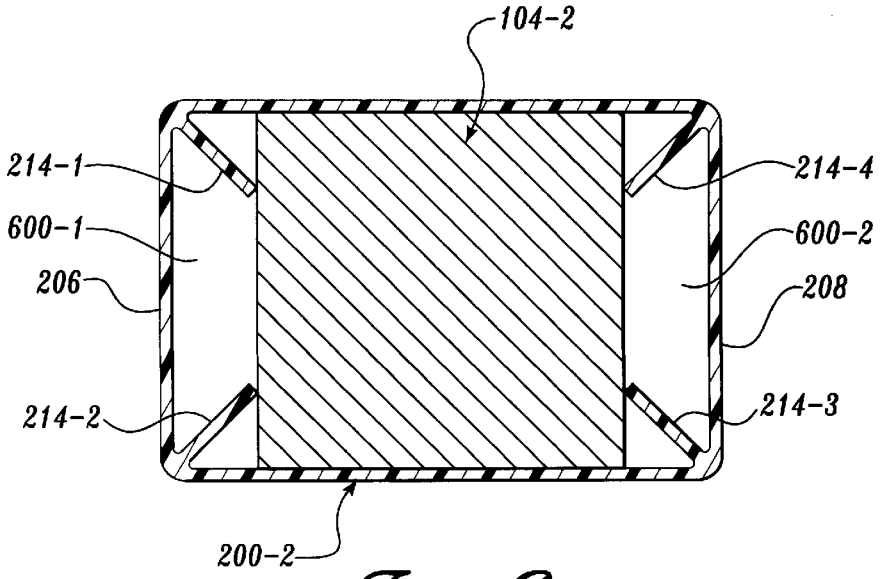
FIG. 6 shows a dowel bar centered within a dowel bar sleeve as in FIG. 5.

FIG. 5 is a partial cross-sectional view along sectional view line 5—5 in FIG. 4. FIG. 6 shows fins 214 centering dowel bar 104-2 between sides 206 and 208 of dowel bar sleeve 200-2 as in FIG. 5, such as before the adjacent cast-in-place slabs 100 move relative to each other parallel to the longitudinal axis of joint 102. Fins 214 are angled and create voids 600-1 and 600-2 (collectively 600), which allow dowel bar 104-2 to move in either direction perpendicular to sides 206 and 208. Fins 214 initially center dowel bar 104. Fins 214 could be designed such that they easily break off or rotate at comer hinge points 500-1, 500-2, 500-3, and 500-4.

Figure 7:
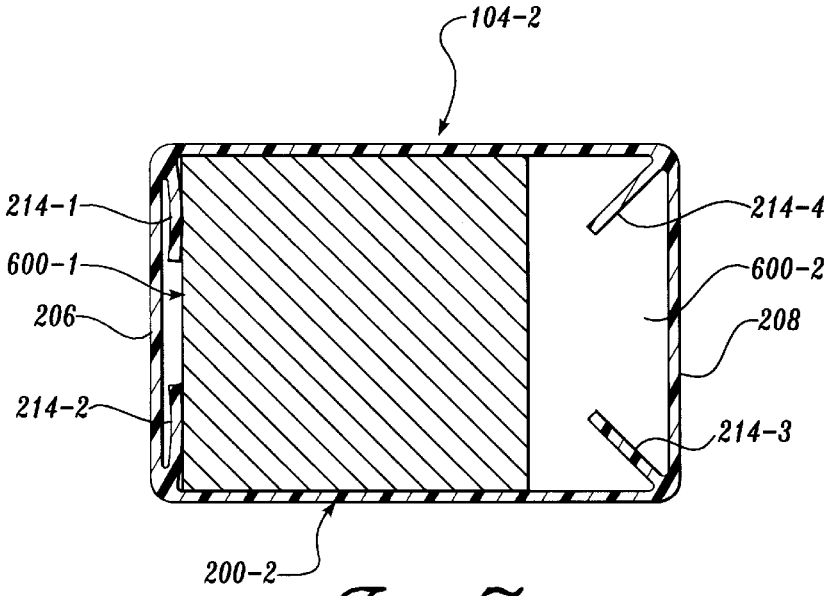
FIG. 7 is similar to FIG. 6 but shows the dowel bar having moved laterally toward one side of the dowel bar sleeve.

FIG. 7 is similar to FIG. 6 but shows dowel bar 104-2 having moved laterally toward side 206 and away from side 208 of dowel bar sleeve 200-2. Fins 214-1 and 214-2 are shown collapsed or folded over and void 600-1 is shown reduced relative to its size in FIG. 6. On the other hand, void 600-2 is depicted as increased in FIG. 7 relative to its size in FIG. 6 due to dowel bar 104-2 moving toward side 206 and away from side 208 of dowel bar sleeve 200. As will be apparent to those having ordinary skill in the art and others, dowel 104-2 is also free to move in the opposite lateral direction, thereby allowing the adjacent slabs on either side of the joint to go through differential lateral shrinkage or expansion in either direction relative to the adjacent slab on the opposite side of the joint. This prevents significant internal concrete stresses and/or cracking from developing as a result of attempted differential lateral movement of adjacent slabs.

Dowel bar sleeve 200 could be manufactured using continuous extrusion methods, with any desired length later being cut from long pieces of the extrusion. Dowel bar sleeve 200 could be installed onto dowel bar 104 either before or after placement of the concrete on either side of a planned joint 102 between cast-in-place slabs. A separate cap or end cover could be applied over an end of dowel bar sleeve 200, if desired, to assure that wetter and finer fresh cast-in-place material mixtures do not excessively enter void 600 of dowel bar sleeve 200.

Dowel bar sleeves 200 restrict differential vertical movement, while allowing joints between adjacent cast-in-place slabs to open in any direction without causing lateral resistance. Without dowel bar sleeves 200, the incompressible sides of dowel bars 104 would restrain attempted lateral contraction parallel to the longitudinal axes of joints 102, thereby causing internal tensile stresses and/or cracking within slabs 100.

Figure 8:
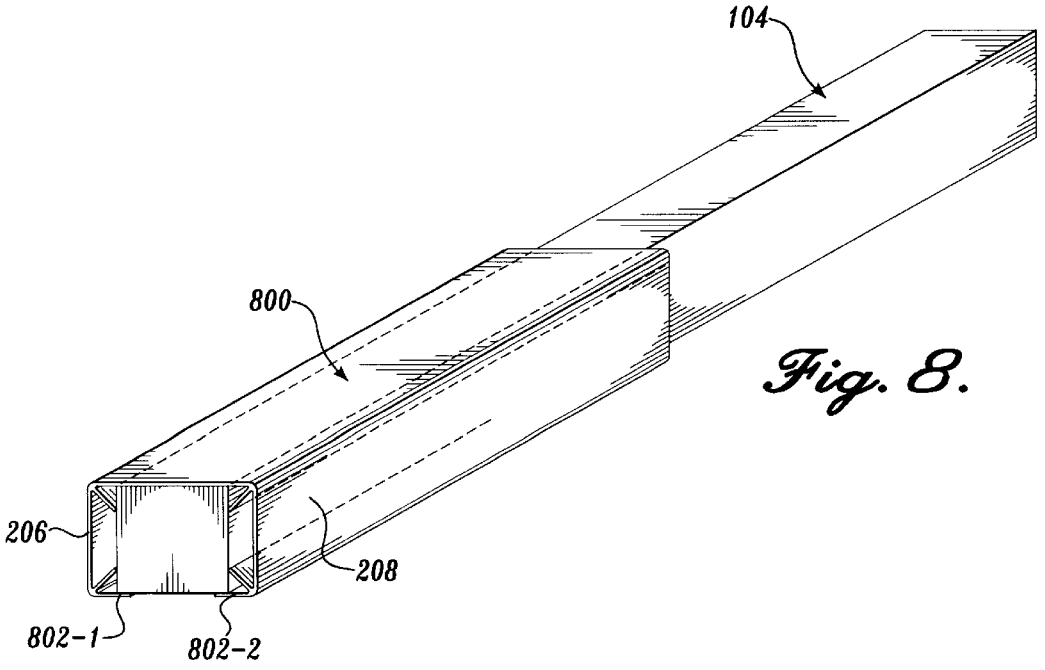
FIG. 8 shows a dowel bar sleeve having an alternate configuration.

FIG. 8 shows a dowel bar sleeve 800 having an alternate configuration. Dowel bar sleeve 800, which differs from dowel bar sleeve 200 only to the extent that, while bottom surfaces 802-1 and 802-2 are attached to sides 206 and 208, respectively, bottom surfaces 802-1 and 802-2 are spaced apart from each other, as opposed to being unitarily formed as is bottom 204. The configuration of dowel bar sleeve 800 allows dowel bar sleeve 800 to be either slid, or spread and snapped, over an end of a square dowel bar 104. The separation between bottom surfaces 802-1 and 802-2 allows much of bottom 212 of dowel bar 104 to contact a surface of a cast-in-place slab directly.

Figure 9:
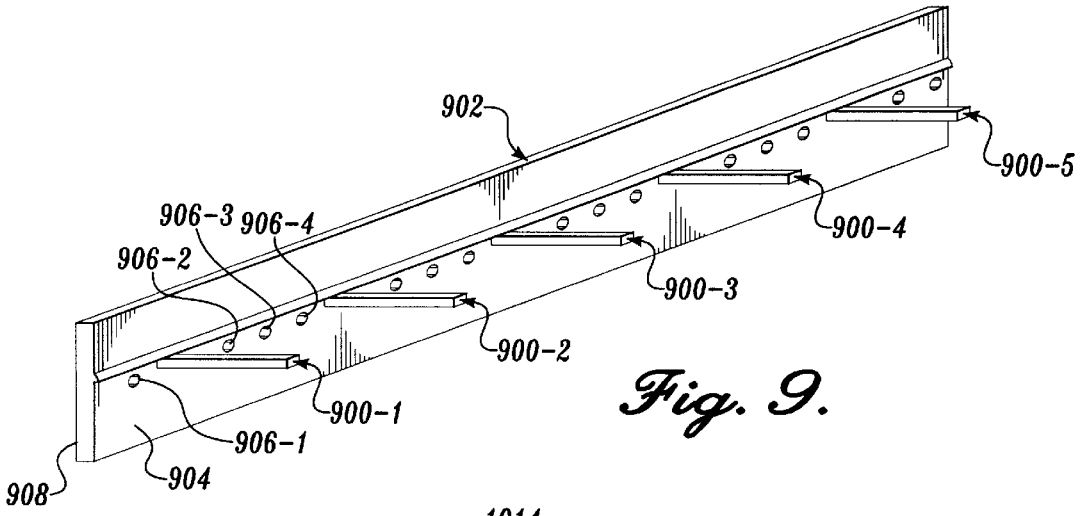
FIG. 9 is a perspective view of blockout bars attached to a rigid form panel.

FIG. 9 is a perspective view of blockout bars 900-1, 900-2, 900-3, 900-4, and 900-5 (collectively 900) attached to rigid form panel 902. Rigid form panel 902 has an inner surface 904 and holes, several of which are referenced in FIG. 9 as 906-1, 906-2, 906-3, and 906-4 (collectively 906). Form panel 902 has an outer surface 908 opposite the inner surface 904 of form panel 902.

Rigid form panel or form face 902 could be made of rigid steel, stiffened if necessary to maintain a planar surface. As will be apparent to those skilled in the art and others, other suitable materials could also be used, and rigid form panel 902 could be used as a form by itself or as a facing with a traditional form.

Rigid form panel 902 and blockout bars 900 can be used to assure that a dowel bar void or dowel bar sleeve is oriented properly, that is, with its upper and lower surfaces parallel to the intended upper surface of a cast-in-place slab. Proper alignment of a dowel bar void and/or of a dowel bar sleeve is critical to proper technical functioning of dowel bars having a rectangular cross-section.

Figure 10:
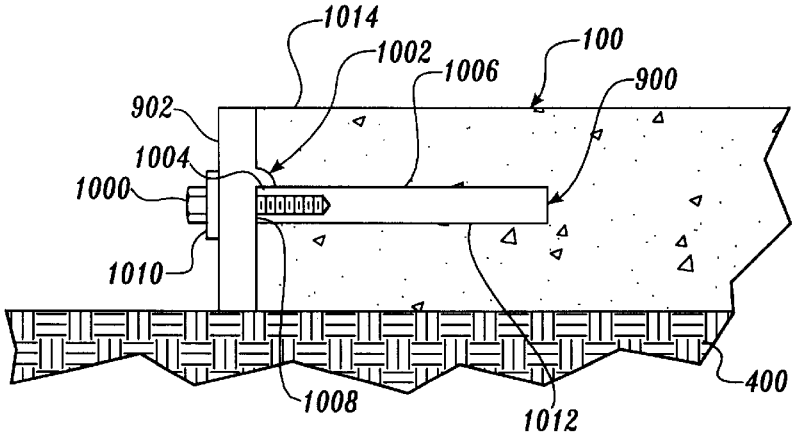
FIG. 10 is a side view of a blockout bar attached to a rigid form panel.

FIG. 10 is a side view of form panel 902, with blockout bar 900 attached to the form panel by an externally threaded bolt 1000 that has been threaded into an end of blockout bar 900. Form panel 902 could have equally spaced holes 906 along its length, for example at 2 inches. Hardened steel bolts, such as bolt 1000, could be inserted through holes 906 at the desired bar spacing to attach blockout bars 900 to form panel 902.

As will be apparent to those skilled in the art and others, blockout bar 900 could be made of steel or any other suitable material. Blockout bars 900 are preferably machined to accurate dimensions, with inner end face 1008 being substantially perpendicular to the substantially planar top and bottom faces 1006 and 1012 of blockout bar 900. Tightening bolt 1000 against the form panel with a large washer or plate 1010 pulls the bar accurately into a fixed position for cast-in-place material placement, with the top and bottom faces 1006 and 1012 of the blockout bars being substantially parallel to the upper surface 1014 of slab 100 and substantially perpendicular to inner surface 904 of form panel 902.

Alignment ridge 1002 is shown with its lower surface 1004 engaging the upper surface 1006 of blockout bar 900. Alignment ridge 1002 properly aligns the upper and lower surfaces of blockout bar 900, and prevents blockout bar 900 from rotating about its longitudinal axis during the rigors of cast-in-place material placement, such as pouring concrete, and when bolts, such as, for example, bolt 1000, are tightened. The top face 1006 of blockout bars 900 securely engage the lower surface 1004 of alignment ridge 1002.

After cast-in-place material is placed against form panel 902 and has hardened, rigid form panel 902 and the one or more blockout bars 900 that were previously attached to form panel 902 are removed. One or more accurately positioned and oriented voids remain, into which full length square or rectangular dowel bars 104 can later be inserted. The full length dowel bars would typically extend to both sides of the formed joint 102. Cast-in-place material could then be placed on the opposite side of the joint, surrounding the ends of the dowel bars that protrude into that space.

Alternatively, a dowel bar sleeve, such as, for example, dowel bar sleeve 200 or 800, could be placed onto blockout bar 900 before pouring slab 100. Then, upon removal of form panel 902 and blockout bars 900, the dowel bar sleeves 200 and/or 800 would remain embedded and properly aligned and positioned within slab 100. As discussed above in connection with voids created by blockout bars 900, full length dowel bars can later be inserted into dowel bar sleeves 200 and/or 800. The full length dowel bars would typically extend to both sides of the formed joint 102. Cast-in-place material could then be placed on the opposite side of the joint, surrounding the ends of the dowel bars that protrude into that space.

After slab 100 hardens, form panel 902 can be removed with blockout bars 900 still attached to form panel 902. Alternatively, blockout bars 900 could be unbolted to allow for simpler removal of form panel 902. Blockout bars 900 could then be individually pulled from the concrete. Any blockout bars 900 that become slightly stuck within slab 100 could be pulled out by reinstalling bolt 1000 into the bar, followed by prying or jacking against the head of bolt 1000 or against a large washer, such as washer 1010, under the bolt head.

Figure 11:
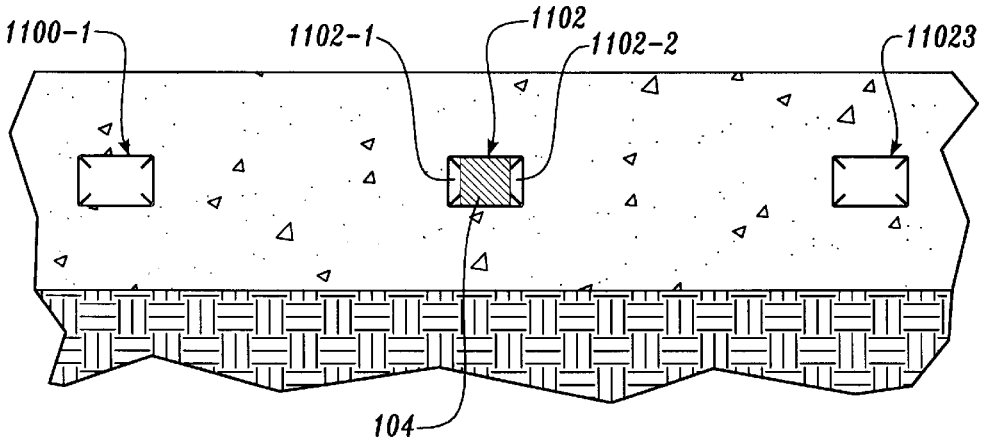
FIG. 11 is a front view of a joint surface having voids created by blockout bars attached to a rigid form panel.

Referring to FIG. 11, the rectangular blockout bars 900 and form panel 902 are capable of producing a series of evenly spaced, accurately aligned, and properly oriented voids 1100-1, 1100-2, and 1100-3 (collectively 1100). Dowel bars 104 having rectangular or square cross-sections, can then be inserted into voids 1100, leaving a void space on each side of the bar while having a snug fit at the top and bottom of the bar. The snug top and bottom fit assures that the bar will provide vertical load transfer between adjacent cast-in-place slabs and that the bar will prevent differential vertical movement of the slabs on each side of the joint. If the slab on one side of the joint moves downward due an applied load on that side of the joint, the bar will transfer the load to the slab on the other side of the joint and cause it to deflect the same amount as the slab on the opposite side of the joint. The void spaces 1102-1 and 1102-2 (collectively 1102) on each side of the bar assure that attempted differential lateral movement is not restrained. These are desirable properties for dowel bars.

Dowel bar sleeves, such as, for example, dowel bar sleeves 200 and/or 800 intended for attachment onto square or rectangular dowel bars, can be temporarily affixed to blockout bars 900 so that proper positioning of the sleeve in the first stage concrete, that is, concrete placed on the first side of the joint, is assured. With dowel bar sleeves such as dowel bar sleeve 800, blockout bar 900 also prevents cast-in-place material from entering the desired void space through the open bottom portion of the dowel bar sleeve.

Figure 12:
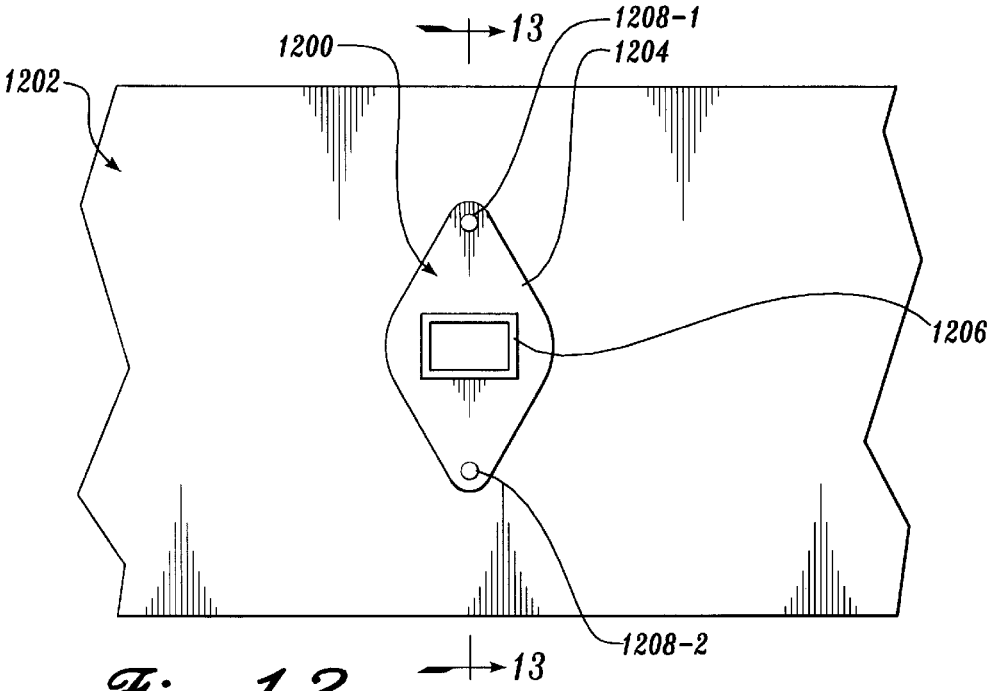
FIG. 12 shows a dowel bar sleeve positioner attached to a form panel.

FIG. 12 is a view of dowel bar sleeve positioner 1200 attached to the inner face of form panel 1202 against which a cast-in-place slab 100 will be formed. Dowel bar sleeve positioner 1200 includes flange 1204, which is substantially planar and is adapted for attachment to form panel 1202. Dowel bar sleeve positioner 1200 also includes stub 1206 that protrudes substantially perpendicularly from flange 1204. Stub 1206 is adapted to have a dowel bar sleeve, such as dowel bar sleeve 200 or 800, fitted over stub 1206.

In order for a square dowel bar 104 to technically function properly, the sleeve is preferably oriented with the top and bottom faces substantially parallel to the top surface or plane of the slab. If dowel bar sleeve positioner 1200 is installed so that its center vertical axis, which is defined by sectional view line 13—13 in FIG. 12, is rotated clockwise or counterclockwise from a line that is perpendicular to the intended upper surface 1300 of slab 100, dowel bar sleeve 200 or 800 and dowel bar 104 will not function properly. Similarly, if dowel bar sleeve 200 or 800 tips downward because of looseness of its fit onto stub 1206, the dowel bar/dowel bar sleeve system of the finished adjacent cast-in-place slabs will not function properly.

Accordingly, dowel bar sleeve positioner 1200 includes accurately positioned holes at 1208-1 and 1208-2 in flange 1200. These holes are aligned on the center vertical axis of dowel bar positioner 1200. The top surface of stub 1206 is preferably flat, smooth, and substantially perpendicular to the center vertical axis of dowel bar sleeve positioner 1200. For a slab 100 that will have a horizontal upper surface, the positioner 1200 could first be attached to the form by a screw or nail through hole 1208-1. A conventional carpenter's level could then be placed on the top surface of stub 1206. The positioner could then be rotated about the screw or nail from which it is hanging through hole 1208-1 until the level indicates that the top surface of stub 1206 is horizontal. The positioner could then be held in place while a second screw or nail is attached through hole 1208-2. This procedure assures precise positioning of positioner 1200, dowel bar sleeve 200 or 800, and, subsequently, dowel bar 104 after form 1202 is removed, and dowel bar 104 is inserted into dowel bar sleeve 200 or 800.

Figure 13:
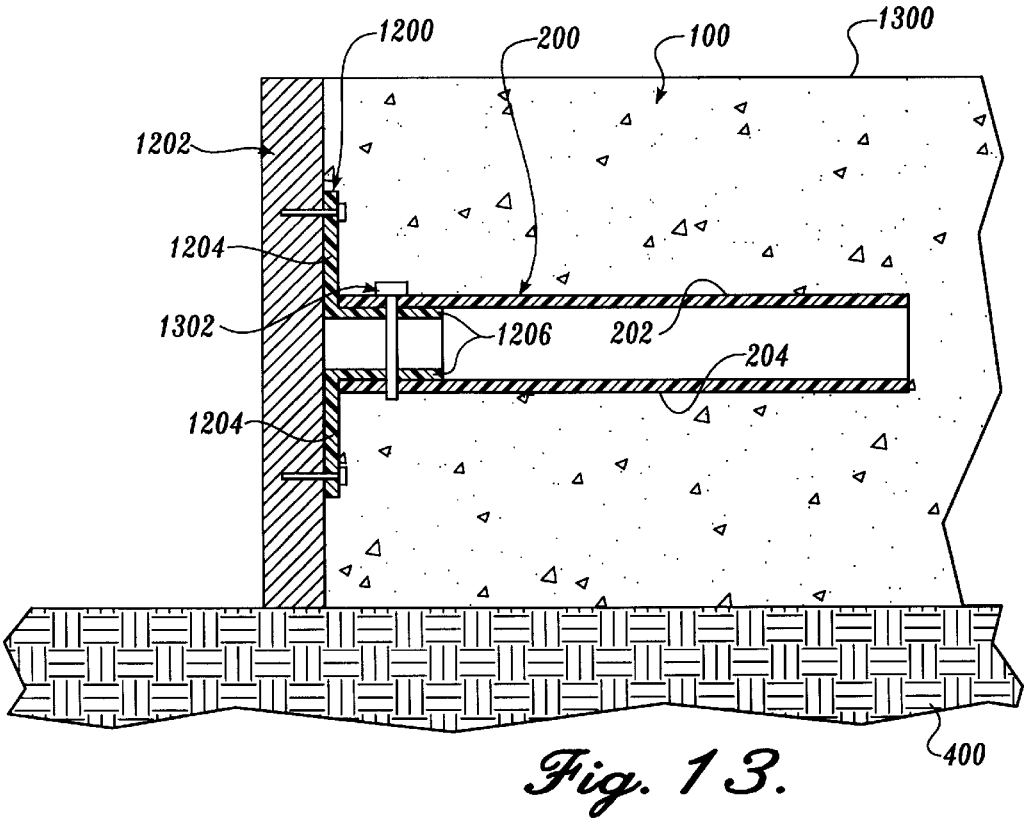
FIG. 13 is a side view of the dowel bar sleeve positioner and form panel of FIG. 12.

FIG. 13 is a sectional view along sectional view line 13—13 in FIG. 12. When dowel bar sleeve positioner 1200 is properly aligned, dowel bar sleeve 200 or 800 will be properly positioned with its top 202 and its bottom 204 substantially parallel to the intended upper surface 1300 of the cast-in-place slab 100. As depicted in FIG. 13, dowel bar sleeve positioner 1300 includes flange 1204, and stub 1206 protruding perpendicularly from flange 1204. FIG. 13 also depicts a dowel bar sleeve 200 slipped over stub 1206.

After slab 100 has been poured and has hardened, form 1202 and dowel bar sleeve positioner 1200 are removed, with dowel bar sleeve 200 or 800 remaining embedded within slab 100. A square or rectangular dowel bar 104 can then be inserted into dowel bar sleeve 200 or 800.

To securely hold dowel bar sleeve 200 or 800 onto stub 1206, pin 1302 can be inserted through holes in the top 202 and bottom 204 of dowel bar sleeve 200, with matching holes in the top and bottom of stub 1206. This affixes dowel bar sleeve 200 or 800 tightly into position so that it does not come loose, fall off, or tip downward during the rigors of cast-in-place material placement. After slab 100 has hardened and form 1202 has been removed, pin 1302 can be sheared by either prying off dowel bar sleeve positioner 1200 or by ramming a bar through dowel bar sleeve positioner.

This invention has been described with reference to preferred embodiments. Modifications may occur to others upon reading and understanding the foregoing detailed description. This invention includes all such modifications to the extent that they come within the scope of the appended claims or their equivalents.

What is claimed is:

1. A dowel bar sleeve adapted to receive a dowel bar having substantially planar, substantially parallel upper and lower surfaces, the dowel bar sleeve comprising:

a. a substantially planar top section;

b. first and second sides attached to the top and extending downwardly from the top;

c. a substantially planar bottom section attached to the first and second sides, the bottom section defining a substantially planar surface substantially parallel to the top section, the top section and bottom section of the dowel bar sleeve being spaced apart such that if the dowel bar is inserted into a dowel bar sleeve, the dowel bar sleeve is adapted to substantially prevent the dowel bar from moving in a direction perpendicular to the top and bottom sections of the dowel bar sleeve;

d. the top and bottom sections of the dowel bar sleeve are substantially wider than the upper and lower surfaces of the dowel bar so that if the dowel bar is inserted into the dowel bar sleeve, the dowel bar can move in a direction toward and away from first and second sides of the dowel bar sleeve; and e. collapsible fins inside the dowel bar sleeve and extending longitudinally along the interior of the dowel bar sleeve for nominally centering the dowel bar between the first and second sides of the dowel bar sleeve and permitting the dowel bar to move toward and away from the first and second sides of the dowel bar sleeve.

2. The dowel bar sleeve as in claim 1 wherein the top and bottom sections of the dowel bar sleeve are made of a substantially incompressible substantially non-malleable material.

3. The dowel bar sleeve of claim 1 wherein: the sides of the dowel bar sleeve are substantially planar and substantially perpendicular to the top and the bottom sections of the dowel bar sleeve.

4. The dowel bar sleeve of claim 1 wherein the bottom section of the dowel bar sleeve further comprises:

a. a first substantially planar bottom surface attached to the first side of the dowel bar sleeve; and b. a second substantially planar bottom surface attached to the second side of the dowel bar sleeve, the first and second planar bottom surfaces being spaced apart from each other.

5. The dowel bar sleeve as in claim 4 wherein the top and bottom sections of the dowel bar sleeve are made of a substantially incompressible substantially non-malleable material.

6. The dowel bar sleeve of claim 4 wherein: the sides of the dowel bar sleeve are substantially planar and substantially perpendicular to the top and the bottom sections of the dowel bar sleeve.

7. The dowel bar sleeve of claim 1, wherein at least one fin projects from the first side toward the second side, and at least one fin projects from the second side toward the first side.

8. The dowel bar sleeve of claim 7 wherein at least two fins project from the first side toward the second side, and at least two fins project from the second side toward the first side.

9. The dowel bar sleeve of claim 7 wherein the fins extend diagonally from their respective sides toward the opposite respective side.

10. The dowel bar sleeve of claim 7 wherein at least one fin projects diagonally from the first side towards the second side, and at least one fin projects diagonally from the second side toward the first side.

11. The dowel bar sleeve of claim 1, wherein at least one fin projects from or near the intersection of the first side with at least one of the top and bottom sections toward the second side, and at least one fin projects from or near the intersection of the second side with at least one of the top and bottom sections toward the first side.

12. The dowel bar sleeve of claim 11 wherein at least one of the fins projects in a diagonal direction toward the respective opposite side.

13. The dowel bar sleeve of claim 1, wherein at least one fin projects from one of the top and bottom sections at a location adjacent the first side and in the direction toward the second side, and at least one fin projects from one of the top and bottom sections at a location adjacent the second side and in a direction toward the first side.

14. A system for creating one or more voids in a cast-in-place slab for insertion of a dowel bar, the cast-in-place slab having a substantially planar upper surface, the system comprising:

a. a rigid longitudinal form panel having an outer surface, a substantially planar inner surface spaced from the outer surface and disposed perpendicular to the intended upper surface of the slab, and one or more holes extending between the inner and outer surfaces;

b. one or more removable blockout bars each closely sized and shaped to the size and shape of the exterior of a dowel bar, and having substantially planar, substantially parallel top and bottom faces and a substantially planar inner end face that is substantially perpendicular to the top and bottom faces;

c. an attachment system engageable with the one or more blockout bars by which a corresponding one of the one or more inner end faces of the one or more blockout bars is attached to the inner surface of the form panel such that the top and bottom faces of the one or more blockout bars are substantially parallel to the intended upper surface of the slab; and d. wherein with the exception of the one or more inner end faces, the one or more blockout bars is of substantially solid composition.

15. The system of claim 14 wherein the system for attaching the corresponding one of the one or more end faces of the one or more blockout bars to the panel comprises:

a. an externally threaded bolt; and b. a hole in the inner end face of the corresponding one of the one or more blockout bars, the hole being internally threaded to receive the externally threaded bolt.

16. The system of claim 14 wherein one or more dowel bar sleeves have been placed onto a corresponding one of the one or more blockout bars, the one or more dowel bar sleeves each having:

a. a substantially planar top;

b. first and second side faces attached to the top and extending downwardly from the top; and c. a substantially planar bottom attached to the first and second side faces, the bottom including a substantially planar surface substantially parallel to the top.

17. A system for creating one or more voids in a cast-in-place slab for insertion of a dowel bar, the cast-in-place slab having a substantially planar upper surface, the system comprising:

a. a rigid longitudinal form panel having an outer surface, a substantially planar inner surface spaced from the outer surface and disposed perpendicular to the intended upper surface of the slab, and one or more holes extending between the inner and outer surfaces;

b. one or more removable blockout bars each closely sized and shaped to the size and shape of the exterior of a dowel bar, and having substantially planar, substantially parallel top and bottom faces and a substantially planar inner end face that is substantially perpendicular to the top and bottom faces; and c. an attachment system engageable with one or more blockout bars by which a corresponding one of the one or more inner end faces of the one or more blockout bars is attached to the inner surface of the form panel such that the top and bottom faces of the one or more blockout bars are substantially parallel to the intended upper surface of the slab, wherein the system for attaching a corresponding one of the one or more inner end faces of the one or more blockout bars to the form panel comprises an alignment ridge protruding from the inner surface of the form panel and constructionally independent of the one or more blockout bars, the alignment ridge having a substantially planar lower surface substantially parallel to the intended upper surface of the slab, for engaging the top surface of the one or more blockout bars and positioning the top and bottom surfaces of the one or more block out bars substantially parallel to the intended upper surface of the slab.

* * * * *

UNITED STATES PATENT AND TRADEMARK OFFICE

CERTIFICATE OF CORRECTION

PATENT NO. : 6,145,262
DATED : November 14, 2000
INVENTOR(S) : E.K. Schrader et al.

It is certified that error appears in the above-identified patent and that said Letters Patent is hereby corrected as shown below:

Title page,
Column 1,
Item [56], Refs Cited, (U.S. Pats., item 7), "Ilu et al." should read -- Hu et al. --

Column 9,
Line 28 (claim 9, line 1), "7," should read -- 8 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*